US011691865B2

(12) United States Patent
Levin et al.

(10) Patent No.: US 11,691,865 B2
(45) Date of Patent: Jul. 4, 2023

(54) LIQUID DISPENSING SYSTEM

(71) Applicants: Chad W. Levin, Nashville, TN (US); Stefanee M. Nielson, Nashville, TN (US)

(72) Inventors: Chad W. Levin, Nashville, TN (US); Stefanee M. Nielson, Nashville, TN (US)

( * ) Notice: Subject to any disclaimer, the term of this patent is extended or adjusted under 35 U.S.C. 154(b) by 0 days.

(21) Appl. No.: 17/476,017

(22) Filed: Sep. 15, 2021

(65) Prior Publication Data

US 2023/0083436 A1 Mar. 16, 2023

(51) Int. Cl.
*B67D 3/00* (2006.01)

(52) U.S. Cl.
CPC ..... *B67D 3/0003* (2013.01); *B67D 3/0058* (2013.01); *B67D 3/0077* (2013.01)

(58) Field of Classification Search
CPC ... B67D 3/0003; B67D 3/0058; B67D 3/0077
USPC ..... 141/94
See application file for complete search history.

(56) References Cited

U.S. PATENT DOCUMENTS 3,993,218 A * 11/1976 Reichenberger ..... B67D 1/04 222/30
5,791,385 A * 8/1998 Stahlecker ..... B67C 3/24 141/270
5,839,483 A * 11/1998 Rejret ..... B67D 1/1466 141/94
6,648,025 B2 * 11/2003 Smith ..... B67D 1/0007 141/2
6,712,101 B1 * 3/2004 Nanaji ..... B67D 7/0496 141/94
8,162,011 B2 * 4/2012 Weems ..... B67D 1/0888 141/82
8,176,948 B2 * 5/2012 Carrig ..... H04W 4/08 141/82
8,813,794 B2 * 8/2014 Ashrafzadeh ..... B67D 1/0888 141/192
10,974,949 B2 * 4/2021 Bishel ..... A47G 23/0241
2015/0047742 A1 * 2/2015 Baldo ..... A47J 31/46 141/378
2016/0255991 A1 * 9/2016 Givens, Jr. ..... A47J 31/41
2017/0210610 A1 * 7/2017 Henson ..... B67D 1/0406
2021/0000290 A1 * 1/2021 Savioz ..... G06F 3/0362

* cited by examiner

*Primary Examiner* — Timothy L Maust
(74) *Attorney, Agent, or Firm* — Hall Estill Law Firm

(57) ABSTRACT

A liquid dispensing system can intelligently dispense liquid from a liquid source to a receptacle via a spout. A controller may be connected to a sensor in a housing of the liquid dispensing system with the housing supporting a liquid dispensing spout connected to a liquid source. The controller can generate, and execute, a liquid dispensing strategy that alters an angle of the liquid dispensing spout with respect to a liquid receptacle to optimize liquid flow into the receptacle.

20 Claims, 4 Drawing Sheets

LIQUID DISPENSING SYSTEM

CROSS-REFERENCE TO RELATED APPLICATIONS

This application claims benefit under 35 U.S.C. 119(e) of U.S. Provisional Application Ser. No. 63/078,609, filed Sep. 15, 2020, which is hereby expressly incorporated herein by reference in its entirety.

SUMMARY

A liquid dispensing system, in some embodiments, has a controller connected to a sensor in a housing that supports a liquid dispensing spout connected to a liquid source. The controller generates, and subsequently executes, a liquid dispensing strategy that alters an angle of the liquid dispensing spout with respect to a liquid receptacle to optimize liquid flow into the liquid receptacle.

Embodiments utilize a liquid dispensing system to position a liquid receptacle proximal a housing that has a controller connected to a sensor and supports a liquid dispensing spout connected to a liquid source. The liquid receptacle is detected with the sensor to allow a liquid dispensing strategy to be generated with the controller based on the detected liquid receptacle. The liquid dispensing strategy is then executed to altering an angle of the liquid dispensing spout with respect to the liquid receptacle.

DETAILED DESCRIPTION

The various embodiments of the current disclosure are generally directed to a liquid dispensing system that intelligently adapts liquid flow characteristics to a detected liquid receptacle optimize liquid dispensing performance.

As automation has increased the efficiency of dispensing liquids into one or more receptacles, issues and difficulties have become prevalent and have yet to be solved by any known technology. For instance, liquid waste and dispenser sanitation degradation are increasingly rampant when a human is partially, or completely, replaced by automation equipment that delivers liquids from a source to a receptacle. The inability to dynamically adapt to different dispensed liquids and/or receptacles can prevent a static automated liquid dispenser from properly providing liquids with optimal characteristics, such as volume and turbulence.

While automation of liquid dispensing can appear to complement human involvement in some business environments, such as bars, coffee shops, and juice stands, such automation can actually result in greater liquid waste and improper tasting liquids. Hence, assorted embodiments are directed at optimizing the partial, or complete, automation of liquid dispensing by reducing liquid waste, improving equipment sanitation, and providing authentic liquid tasting characteristics. The use of various embodiments of a liquid dispensing system, businesses can enjoy increased liquid throughput and greater customer satisfaction while non-commercial users may enjoy greater sanitation and more authentic liquid flavors than a purely, or partially, manual liquid dispensing.

Figure 1:
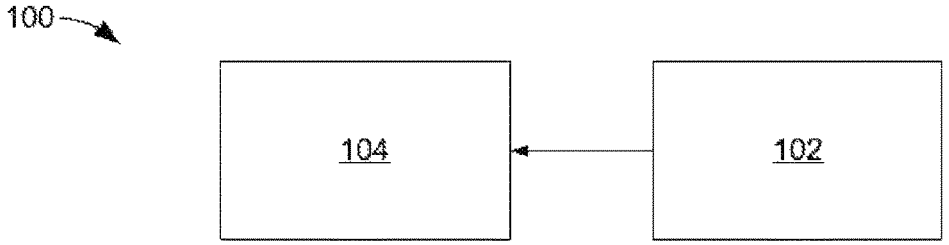
FIG. 1 is a block representation of an example liquid dispensing environment in which assorted embodiments can be practiced.

Turning to the drawings, FIG. 1 represents an example liquid dispensing environment 100 in which assorted embodiments of the present disclosure can be practiced. A liquid source 102 can be physically manipulated to move liquid to one or more receptacles 104. A liquid source 102 is not limited to a particular type, size, or position just as a receptacle is not limited to any material, shape, volume, or position. However, it is contemplated that the liquid source 102 has a greater volume than the receptacle 104 and is physically manipulated to allow gravity to force liquid into the receptacle 104.

Figure 2:
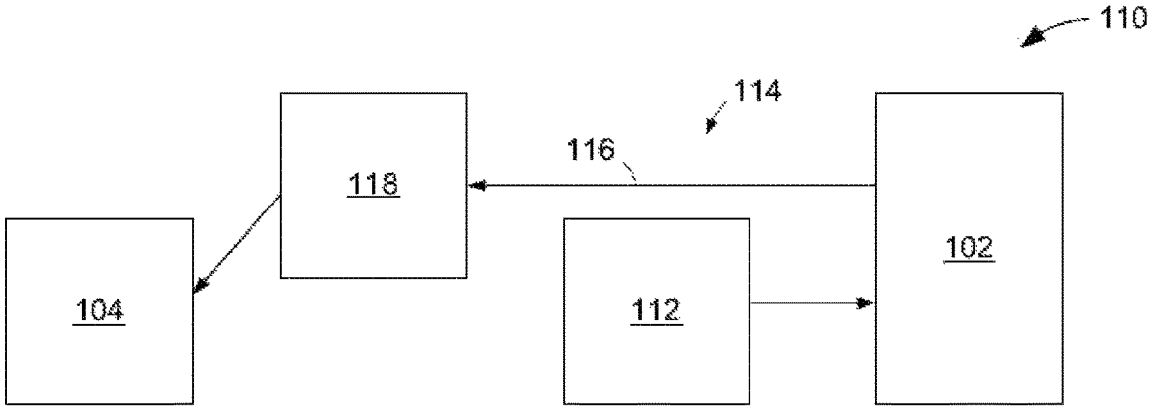
FIG. 2 depicts an example liquid dispensing environment capable of being optimized in various embodiments.

FIG. 2 depicts a block representation of another example liquid dispensing environment 110 where a liquid source 102 is physically manipulated by pressure delivered from a separate component 112. Through the regulated delivery of pressure to the source 102, liquid can be forced to a receptacle 104 via a delivery assembly 114, which can consist of one or more sealed lines 116 and a selectable spout 118. The spout 118 may be any liquid switch, such as a valve, gate, or opening, that allows for a flow of liquid to be turned on or off.

As a non-limiting example, spout 118 may have a handle, electronic solenoid, or crank that allows a user to select a flow of liquid from the source 102 to the receptacle 104. It is contemplated that the spout 118 may operate in conjunction with the pressure component 112 to alter the volume, pressure, and/or velocity of liquid. In the non-limiting case of a bar where a bartender utilizes the spout 118, the receptacle 104 may be manipulated by hand in a variety of manners, which may correspond with the manipulation of liquid flow via the spout 118, to partially or completely fill the receptacle with desired liquid characteristics, such as volume, foam amount, and turbulence.

Figure 3:
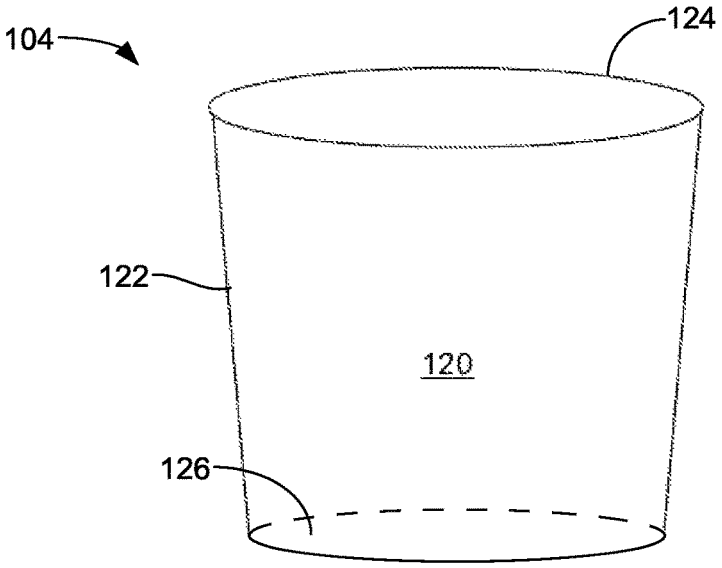
FIG. 3 Related Art
FIG. 3 represents an example receptacle of the related art that can be filled with a dispensed liquid in accordance with some embodiments.

In the line representation of an example receptacle 104 in FIG. 3 that can be utilized in the environments 100/110 of FIGS. 1 & 2, filling of the receptacle with liquid can pose challenges and difficulties that have yet to be solved by completely, or partially, automated liquid dispensing systems. For reference, the example receptacle 104 is shown to take the form of a drinking glass or cup having an interior volume 120 defined by a circumferentially extending, frusto-conically shaped sidewall 122, annular opening (lip) 124 and base 126.

For completely manual liquid dispensing directly from a source 102 or via a delivery assembly 114, waste, efficiency, and sanitation are the key issues as a human manipulates a spout 118, or source 102, to transfer liquid into a receptacle. While an experienced dispenser of liquids may minimize liquid waste, the inefficiency of waiting until individual receptacles are filled is always present. The inadvertent dunking of the spout 118, or source 102, into the dispensed liquid in a receptacle can lead to the growth of bacteria and the transmission of viruses and disease while negatively impacting the taste of dispensed liquids.

The advent of partially, or completely, automated liquid dispensing can remove some, or all, human involvement with filling a receptacle with liquid to improve efficiency, but can be wrought with waste and ill-tasting dispensed liquids. The dispensing of liquid in a partially automated arrangement, in accordance with some embodiments, involves a human positioning a receptacle proximal a spout and/or manipulating a spout. Such arrangement leaves the receptacle, the volume of dispensed liquid, and the position of the spout relative to the spout in question, which jeopardizes the sanitation of the spout, the amount of liquid waste, and the quality of the dispensed liquid taste.

A fully automated liquid dispensing system has no human involvement other than placing an order and receiving a filled receptacle. Such systems may provide more consistent, and reliable, pouring of a predetermined volume of liquid that avoids dunking the spout in an unsanitary manner, but can be highly inefficient as numerous computing systems are often involved with carrying out the positioning of a receptacle, activating liquid pouring, deactivating liquid pouring, and releasing the receptacle to a customer. In addition, fully automated systems have been highly static in nature, which corresponds with a uniform receptacle and pouring technique being employed regardless of the type of liquid dispensed or customer preference.

Figure 4:
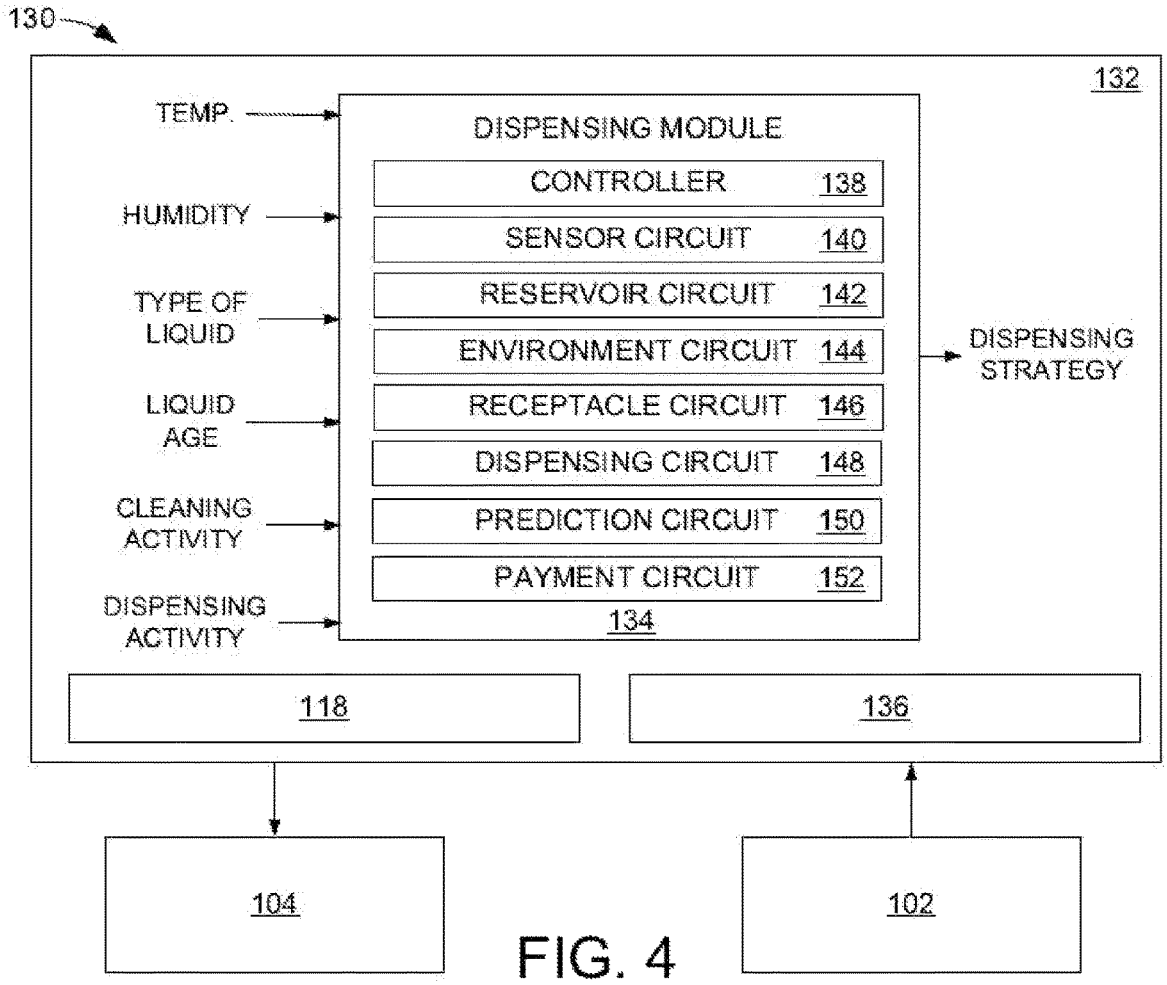
FIG. 4 conveys liquid dispenser that can be utilized in the environments of FIGS. 1 & 2 in accordance with assorted embodiments.

With these issues in mind, various embodiments configure a liquid dispensing system as a partially automated arrangement that allows for higher customer throughput than a fully automated system while intelligently minimizing waste, unsanitary conditions, and ill-tasting dispensed liquids. FIG. 4 depicts a block representation of an example liquid dispenser 130 that can be utilized to carry out embodiments of the present disclosure. While not limiting or required, the dispenser 130 has a housing 132 in which a dispensing module 134 is positioned and connected to at least a spout 118, liquid source 102, and one or more sensors 136 that can physically and/or indirectly interact with a receptacle 104.

It is contemplated that a sensor 136 can be any mechanical, optical, acoustic, or magnetic mechanism that can determine the presence of a receptacle 104 a predetermined distance from the housing 132 and/or spout 118 as well as the type, size, shape, and interior volume of the receptacle 104. That is, any number of sensors 137 can be redundantly, sequentially, or individually employed to detect the presence of a receptacle 104 and determine characteristics of the receptacle 104 to allow the dispensing module 134 to accurately generate a liquid dispensing strategy customized to the actual receptacle 104 to be filled.

The dispensing module 134 can be resident as hardware and software in the housing 132 to translate a number of different inputs, such as environmental information, current liquid status, and detected receptacle information, into one or more liquid dispensing strategies. Although not limiting, various embodiments of a dispensing strategy prescribe how liquid should be provided to the receptacle 104 to minimize liquid waste, mitigate sanitary issues with the spout, decrease dispensing time, and provide liquid with optimized flavor characteristics. To that end, the dispensing module 134 can have a controller 138, such as microprocessor or programmable circuitry, that directs the generation, alteration, and administration of liquid dispensing strategies.

A sensing circuit 140 can cooperate with the controller 138 to evaluate the status of connected sensors and activate selected sensors to carry out a liquid dispensing strategy. The sensing circuit 140 may conduct one or more tests on a sensor 136 to determine the accuracy and/or performance of the sensor 136, which can be compensated by the controller 138 as part of a liquid dispensing strategy. That is, the sensing circuit 140 may determine that a sensor 136 is consistently misreading a position of a receptacle 104 and compensates for such misreading by prescribing a correction to the particular sensor 136, a redundant measurement by another sensor 136, or ignoring the measurements from the ill-reading sensor 136.

The status and operation of a liquid source 102 can be aided with a reservoir circuit 142 that can monitor the amount of liquid available for dispensing, pressure available to transport the liquid to a receptacle 104, and quality of liquid. For instance, the reservoir circuit 142 can utilize one or more sensors 136, inputted liquid characteristics, such as type, temperature, and viscosity, as well as logged liquid activity to determine how much liquid is available and what dispensing characteristics should be employed to dispense the liquid at optimal flavor and texture. Such determinations by the reservoir circuit 142 allow a generated liquid dispensing strategy to consider and optimize the current status of a stored liquid, which can be particularly important when a dispenser 130 is connected to multiple different liquid sources 102.

Various environmental conditions can be detected and determined by an environmental circuit 144. The monitoring of at least the temperature, humidity, pressure, liquid velocity, spout position, and spout angle by the environmental circuit 144 allows the liquid dispensing strategy to prescribe proactive and/or reactive actions, such as heating, cooling, pressure alteration, physical liquid source movement, receptacle movement, or spout movement, to establish and maintain optimal dispensing conditions throughout the delivery of liquid to a receptacle. It is contemplated that the environmental circuit 144 confirms external inputted information and ensures the dispensing strategy being executed maintains the optimal liquid pressure, temperature, and liquid velocity when exiting the spout into the receptacle 104.

The dispensing module 134 can employ a receptacle circuit 146 to translate sensed receptacle 104 information into operating parameters to provide an optimal amount of liquid with characteristics corresponding to an optimized taste. The receptacle circuit 146, in some embodiments, visually maps the opening of a receptacle, the entire interior volume of the receptacle, the material of the receptacle, and/or the position of the receptacle relative to a liquid delivery spout 118. Such visual mapping is not required, but allows the controller 138 ample information to determine how assorted liquid dispensing conditions will result. In other words, the receptacle circuit 146 can take sensed information and provide the controller 138 with receptacle information that allows the dispensing strategy to compensate for receptacle position, shape, size, and material to provide optimal liquid dispensing and subsequent flavor.

A dispensing circuit 148 may complement other aspects of the dispensing module 134 to establish and maintain the best physical position and operation of the spout 118 to deliver liquid to a receptacle 104. The dispensing circuit 148 can monitor ongoing liquid dispensing through one or more sensors 136 to ensure the receiving receptacle 104 has not moved and the dispensing parameters of the spout 118 have not been altered. The ability to continuously monitor dispensing parameters of a spout 118 and receptacle 104 allows the dispensing module 134 to reliably provide optimized liquid delivery, even if dispensing parameters change over time.

While the dispensing module 134 can handle a diverse variety of changing liquid storage and dispensing conditions, some embodiments of the dispensing module 134 employs a prediction circuit 150 to allow a dispensing strategy to efficiently and thoroughly accommodate future liquid storage and dispensing conditions. That is, a prediction circuit 150 can forecast one or more future conditions and/or performance characteristics of the liquid, dispenser, spout, and receptacle based on at least one detected condition. For instance, the prediction circuit 150 can translate detected changes in temperature, previously logged movement of a receptacle in response to dispensed liquid, and/or sensed spout position relative to a receptacle opening into one or more future events/conditions, such as turbulent liquid flow in the receptacle, excessive liquid temperature, or incorrect spout position to produce optimal liquid interaction with the interior of the receptacle.

The prediction of one or more future actions and/or conditions allows the dispensing module 134 to equip the dispensing strategy with one or more proactive and/or reactive actions to prevent, or at least mitigate, predicted conditions that could jeopardize the performance of dispensing or the quality of the dispensed liquid. For proactive actions installed in the dispensing strategy based on conditions/performance predicted by the prediction circuit 150, the dispensing module 134 may generate a triggering event, such as a performance value and/or detected dispensing parameter, that prompts the proactive action to be executed. A non-limiting example involves detection of a certain type, shape, or position of a receptacle with one or more proactive alterations to the current dispensing configuration, such as liquid pressure or spout location, to prevent excessive liquid turbulence during flow into the receptacle.

While assorted aspects of the dispensing circuit 134 can involve the operation of translating liquid from a source into a receptacle, some aspects may additionally involve conducting business interactions with a customer/user. That is, a payment circuit 152 of the dispensing module 134 can conduct a variety of user engagements that ensure the customer/user is of proper age and/or has supplied ample payment before any liquid is dispensed. It is contemplated that the payment circuit 152 may complement human interaction with a customer/user, but some embodiments have the payment circuit 152 conducting completely autonomous interactions with a customer/user without the involvement of any human.

Figure 5:
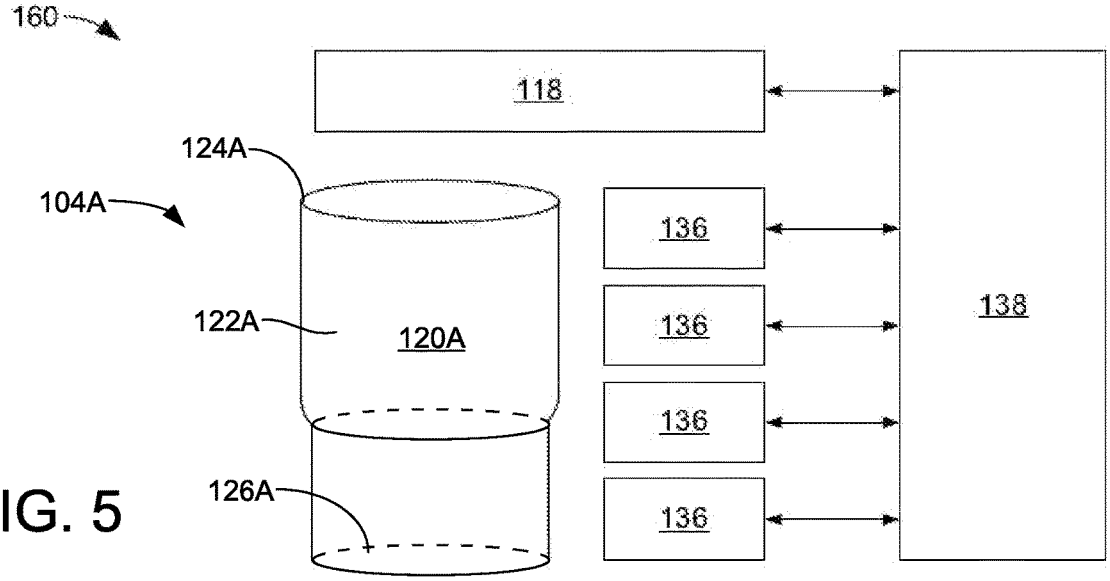
FIG. 5 depicts a line representation of portions of an example liquid dispensing system configured in accordance with various embodiments.

FIG. 5 depicts portions of an example liquid dispensing system 160 operated in accordance with various embodiments to provide optimal liquid delivery to another receptacle 104A. The receptacle 104A is somewhat similar to the receptacle 104 discussed above and may be characterized as a pint glass with an interior volume 120A, an irregularly shaped outer sidewall 122A, opening 124A and base 126A. The receptacle 104A can be positioned proximal a dispenser housing 132 and detected by one or more sensors 136, which prompts a dispensing module controller 138 to conduct a receptacle analysis, as directed by a predetermined dispensing strategy. That is, a dispensing strategy can direct how a receptacle is analyzed depending on any number of encountered conditions, such as position relative to a spout 118, timing with respect to other dispensing events, and environmental parameters of the liquid and/or receptacle.

With a dispensing strategy in place, placement of the receptacle within detecting distance of the dispenser housing 132 prompts immediate analysis of the receptacle 104 by the respective dispenser sensors 136 to customize how liquid will be delivered to the receptacle 104 in an optimized manner according to the dispensing strategy. The customization of liquid dispensing parameters may involve altering the position of the receptacle 104, such as tilting the receptacle 104, moving the position of the spout 118 relative to the receptacle 104, or tilting the spout 118 relative to a receptacle opening. By customizing the liquid dispensing parameters, liquid can be delivered to the receptacle with the volume, pressure, turbulence, and temperature that optimizes liquid flavor while minimizing waste and mitigating the growth of bacteria and unwanted contaminants in the spout 118 and liquid delivery lines 116.

A lack of an established dispensing strategy when a receptacle 104 is placed near the dispensing housing 132 triggers a default dispensing protocol to be executed in lieu of a customized dispensing strategy being generated by a dispensing module. Such a default dispensing protocol may involve static, or dynamic, liquid dispensing characteristics based on the most recently logged dispensing parameters. For instance, one or more liquid dispensing parameters, such as spout position, liquid pressure, and liquid volume, can be executed based on a number of recently conducted dispensing activity, such as the past five, ten, or within the last 24 hours. In some embodiments, a default dispensing protocol adapts spout position in real-time based on detected sensor 136 conditions, such as liquid interaction with the interior of the receptacle 104.

During the execution of a customized dispensing strategy or default dispensing protocol, the spout 118 can be moved before and/or during liquid dispensing just as the position of the receptacle 104 can be altered before and/or during liquid dispensing. For example, the position of the spout 118 relative to the receptacle 104 can be adjusted while liquid flows into the receptacle 104, which can provide dynamic liquid engagement with the interior of the receptacle 104 as well as liquid present in the receptacle 104. The dynamic adjustment of the spout 118 and/or receptacle 104 during liquid delivery, particularly in response to sensed dispensing conditions and a predetermined dispensing strategy, ensures liquid enters and remains in the receptacle 104 in a desired manner, which contrasts manual or unintelligent liquid dispensing that can utilize static dispensing conditions that produce liquid waste and contaminate the spout 118 with residual liquid that breeds unwanted molecules.

Figure 6:
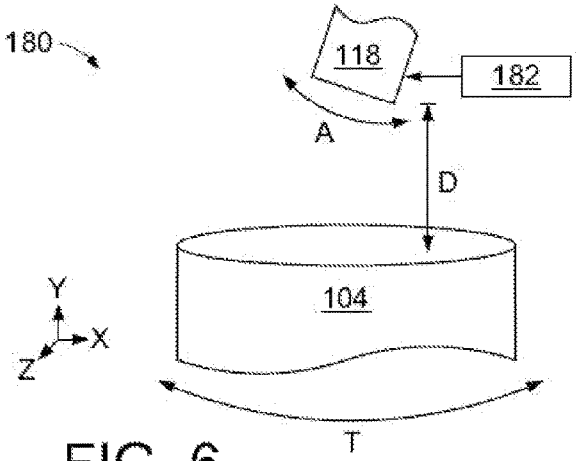
FIG. 6 conveys a line representation of portions of an example liquid dispensing system that can be utilized in the environments of FIGS. 1 & 2.

As shown in the line representation of portions of an example liquid dispensing system 180 in FIG. 6, the spout 118 can be adjusted for angle (A) along the X-Y plane using a spout angle adjustment mechanism 182. In similar fashion, the receptacle 104 can be tilted (T) in the X-Y plane. The distance (D) from the spout 118 to various portions of the interior of the receptacle 104 can be also adjusted before and during liquid delivery using the spout angle adjustment mechanism 182. It is contemplated that one or more liquid conditioning tools, such as a diverter, filter, aerator, or condenser, can be selectively utilized in the spout 118 to alter the manner in which liquid is delivered to the receptacle 104. As a non-limiting example, a dispensing strategy can call for filtered liquid delivery of less than all of the liquid in the receptacle and activates an automated filter to engage the spout 118 at a detected point in the filling of the receptacle 104.

The ability to intelligently detect liquid dispensing and receptacle conditions in order to make dynamic adjustments to dispensing activity to optimize liquid delivery in accordance with a dispensing strategy can establish and maintain at least liquid turbulence, temperature, and position within the receptacle 104 that corresponds with optimal liquid flavor and status without producing liquid waste or contaminating the spout 118. The complete automation of liquid delivery in accordance with a predetermined dispensing strategy once a user positions a receptacle 104 proximal a dispensing housing 132 can reduce the time, processing, and delay often associated with fully automated dispensing systems. In other words, the use of intelligent sensing along with predetermined dispensing strategies provides intelligent efficiency in combination with optimal liquid delivery without undue time associated with generating dispensing modifications and/or routine.

Figure 7:
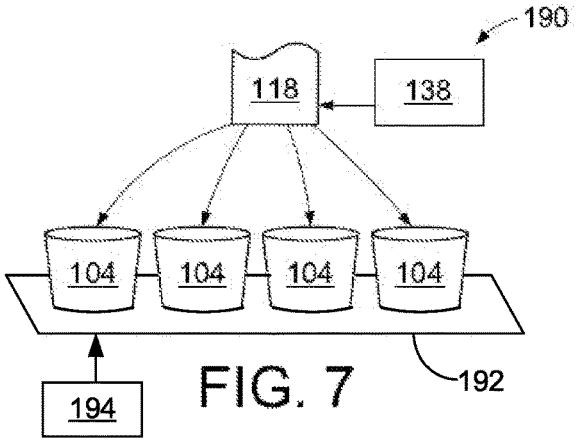
FIG. 7 shows a line representation of portions of an example liquid dispensing system constructed and operated in accordance with assorted embodiments.

While the generation and execution of a dispensing strategy can be completely automated, some embodiments can conduct liquid dispensing in a partially automated manner. Although not required or limiting, a dispensing strategy can prompt a user to conduct assorted activities to aid in the dispensing of liquid. FIG. 7 depicts a block representation of an example liquid dispensing system 190 that delivers a variety of different liquids to different receptacles 104 in a partially automated manner. A dispensing controller 138 can generate one or more dispensing strategies for different liquids to be delivered to different receptacles 104 once a user/customer manipulates the respective receptacles 104 relative to a spout 118.

For instance, a flight of different liquids can be dispensed to different receptacles 104 with different dispensing strategies involving different liquid pressures, spout positions, and/or receptacle tilts. Such different dispensing strategies can be conducted automatically or after prompting a user/customer to perform one or more activities, like moving a receptacle to a designated position such as on a horizontally extending base support 192. Through the use of user/customer prompts, an assorted variety of liquids can be quickly dispensed with individualized and customized delivery parameters. Such partially automated liquid dispensing can provide optimal delivery of flights of different liquids, such as alcohol, beer, coffee, or juice, that have different pressures, turbulence, and/or temperatures corresponding with optimal liquid flavor and status. Tilting of the respective receptacle(s) during the dispensing of the liquid(s) can be carried out using a receptacle tilt angle adjustment mechanism 194.

Figure 8:
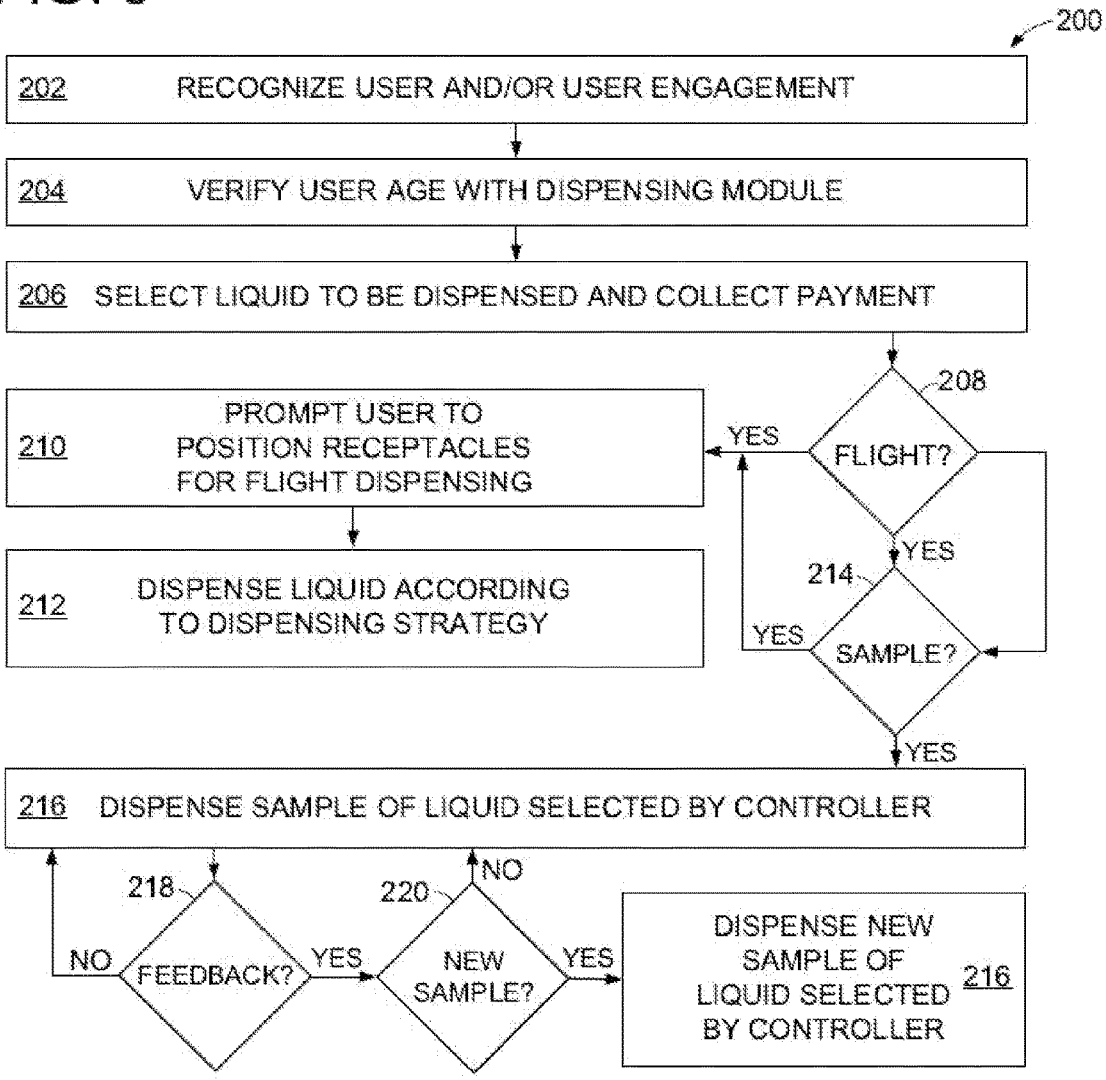
FIG. 8 provides a flowchart of an example dispensing routine that can be utilized as part of a liquid dispensing system in some embodiments.

FIG. 8 conveys an example dispensing routine 200 that can be utilized as part of a liquid dispensing system in some embodiments. Initially, a dispensing system can recognize a user/customer in step 202 through one or more sensors and/or the engagement of the system by the user/customer. It is contemplated that the dispensing system detects a user's identity in step 202, such as through face recognition, password entry, key fob engagement, or mobile device linking, which prompts the loading of an individualized user profile. The loading of a custom user profile can prompt the alteration of a liquid dispensing strategy to provide user preferences, such as liquid temperature, volume, foam, and dispensing speed.

The dispensing system, regardless of whether a user has an individualized profile, may verify the age of the user via one or more techniques in step 204, such as optically scanning an ID card, accessing an authenticating age database, or signing an affidavit of age. Confirmation of proper age of a user/customer allows the selection of one or more liquids to be dispensed in step 206 along with payment of such selection. For instance, a user/customer may make a verbal, mechanical, or digital selection of a liquid followed by remitting payment to the dispensing system, such as by submitting a digital payment, scanning a prepaid card or fob, or entering a payment code.

Once a liquid selection and payment have been made, the liquid dispensing system can generate and/or alter a dispensing strategy to provide the selected liquid(s) in the most efficient manner possible while ensuring the optimal flavor and status of the dispensed liquid. Hence, the liquid dispensing system can evaluate in decision 208 if a flight of different liquids are to be dispensed to different receptacles. If a flight is selected, step 210 prompts the user/customer to position various receptacles proximal to a dispensing spout so that liquid can be delivered in step 212 according to the previously generated dispensing strategy for a respective liquid and receiving receptacle.

In the event no flight is selected, decision 214 evaluates if the user/customer desires a sample volume of a liquid. A sample can be characterized as less than a full portion of a liquid and can be prompted by the liquid dispensing system in an effort to alter and/or complement the purchasing behavior of the user/customer. That is, the dispensing system may prompt the user/customer for a sample even if no sample has be actively chosen. Conversely, a menu of available samples may be provided to the user/customer in association with decision 214. It is noted that the use of liquid samples can reduce user/customer selection times while promoting greater diversity of liquid selection.

A selection of a sample by a user/customer triggers step 216 to execute the dispensing of the selected sample in accordance with a predetermined dispensing strategy in step 218. Routine 200 can then ask for feedback from the user/customer regarding the dispensed sample in decision 220. If the user/customer provides feedback to one or more questions issued by the dispensing system in verbal, physical, or digital form, the dispenser controller can issue one or more follow up questions and/or evaluate if a new sample is to be suggested or dispensed in decision 222. An indication from the user/customer that a new sample is likely to result in additional sales of liquids prompts the dispenser controller to dispense a new sample of liquid determined by the controller based on the user/customer's feedback, prior samples dispensed, and sensed conditions about the user/customer, such as ethnicity, gender, age, voice profile, and indicated liquid dispensing parameters.

The lack of any indication that a new sample will result in an upsell of additional liquids from decision 222, or if no feedback is actively or passively provided from decision 220, causes step 216 to be executed and the original liquid order being dispensed. Through routine 200, sample liquids can be dispensed before, or after, the dispensing of liquid ordered by the user/customer, which can lead to a better knowledge of available liquids by the user/customer as well as an opportunity to upsell previously unordered liquids. The computing capabilities of the dispenser controller and assorted circuitry of the dispensing module allows for a variety of sophisticated business growth and education embodiments, which complements the customized adjustment of liquid dispensing in response to sensed receptacle parameters and conditions.

Figure 9:
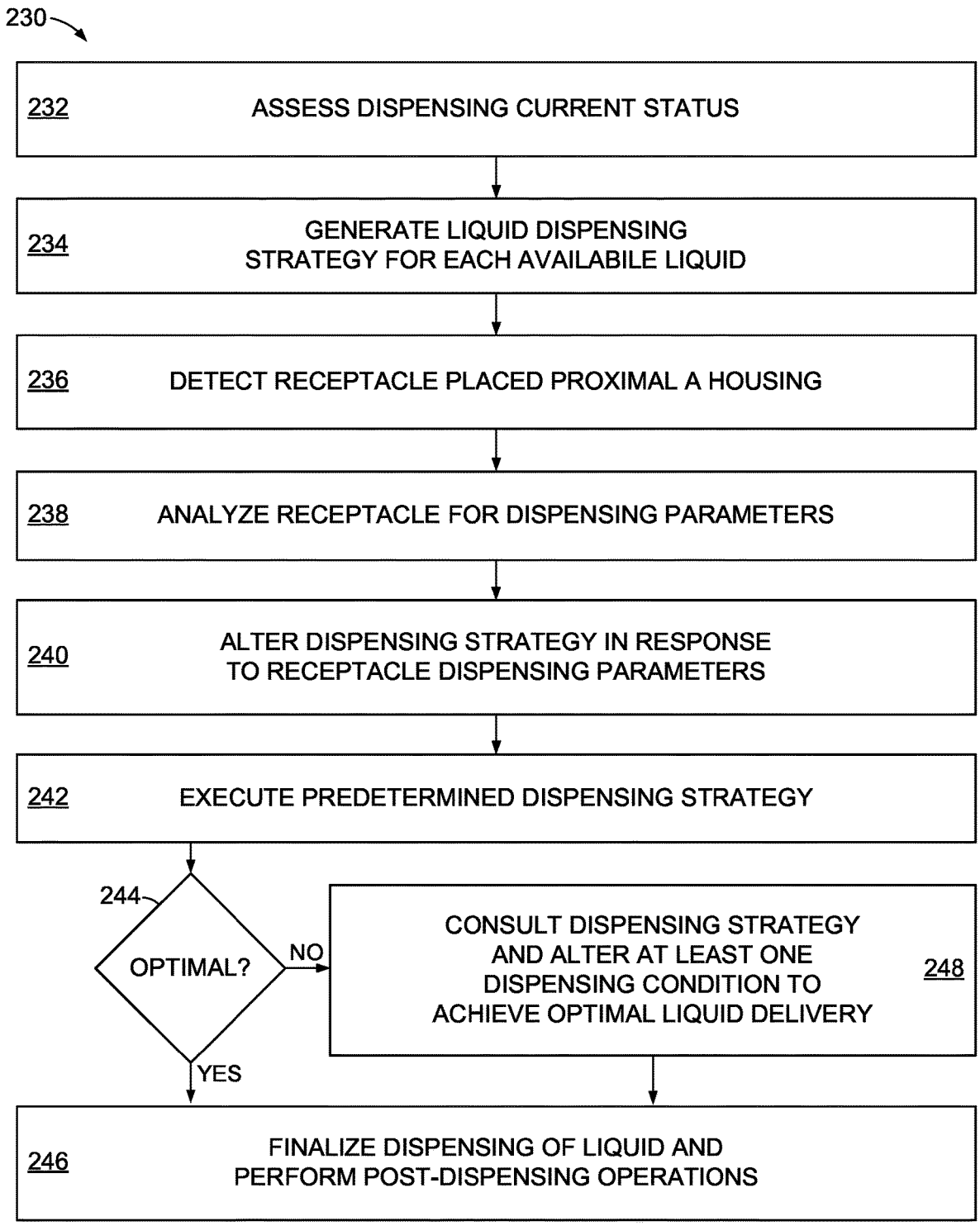
FIG. 9 conveys an example liquid dispensing routine that may be employed by the various embodiments of FIGS. 1-7.

FIG. 9 depicts an example liquid dispensing routine 230 that can be carried out by assorted aspects of a liquid dispenser in accordance with various embodiments. Prior to any receptacle being positioned for liquid dispensing, a dispenser controller can assess the current status of the liquid(s), liquid delivery lines, pressure source, and spout in step 232 in order to ascertain the liquid dispensing capabilities of the dispenser. The current status of the dispenser is then used in step 234 to generate a liquid dispensing strategy for each available liquid. It is noted that step 234 could result in multiple different dispensing strategies being generated and assigned to assorted liquids, which may involve differing dispensing parameters, such as pressure, temperature, and flow velocity.

Although not required or limiting, a liquid dispensing strategy generated in step 234 can have one or more proactive and reactive actions to be executed in response to detected conditions. For instance, a proactive action may be expelling gas from a pressure source to induce liquid motion within a source container, which essentially "stirs" the liquid. Another proactive action can involve expelling gas or a cleaning liquid from the spout to clean, remove debris, and/or optimize liquid flow. Meanwhile, reactive actions may involve altering operating conditions while liquid is being dispensed, such as moving the spout, tilting the spout, altering the angle of a receptacle, or changing liquid flow rate, in response to a predetermined trigger event, such as detected liquid flow deviation, unwanted liquid turbulence, irregular liquid flow from the spout, spout debris, unsanitary spout condition, or low pressure capability from a pressure source.

Regardless of the number, type, and correcting action prescribed by a dispensing strategy generated in step 234, the customization of liquid dispensing operation based on detected receptacle characteristics ensures efficient, accurate, and reliable correcting actions if/when dispensing conditions are appropriate. Accordingly, step 236 then awaits a receptacle to be positioned proximal to a dispenser housing and detected by at least one dispenser housing sensor. Detection of the receptacle is followed by an analysis of the receptacle by sensors in step 238 to determine at least the shape, volume, opening diameter, and material of the receptacle. In some embodiments, step 238 maps the interior volume of the receptacle in order to determine where liquid should enter and react with the sidewalls of the receptacle to produce an optimal pour and liquid flavor.

The analysis of the receptacle in step 238 allows step 240 to alter the dispensing strategy to provide liquid dispensing parameters optimized to the receptacle. A non-limiting example selects one of several different options for spout position and liquid flow velocity in the dispensing strategy to provide the best liquid delivery into the receptacle. The selected dispensing options are then executed in step 242 with a pressure source activated to a liquid source to move liquid to the dispenser housing spout positioned at a customized position relative to the receptacle.

While the customized dispensing conditions may be maintained until a predetermined volume of liquid is present in the receptacle, some embodiments monitor the dispensing of the liquid with dispenser sensors to ensure continually optimized liquid delivery. Thus, decision 244 evaluates how liquid is being delivered by the spout and received by the receptacle to determine if optimal conditions predicted by the dispensing strategy are present. If so, routine 230 advances to step 246 where dispensing is finalized and one or more cleaning and/or maintenance operations are conducted, such as expelling gas or liquid through the spout and/or liquid source.

In the event liquid delivery becomes sub-optimal during dispensing, step 248 consults the dispensing strategy to quickly adapt dispensing parameters to produce optimal liquid flow and delivery. It is contemplated that sub-optimal liquid dispensing can be predicted by a dispenser controller prior to becoming sub-optimal in actuality. As a result of quick dispensing adaptations while liquid is flowing, as directed by the dispensing strategy, liquid flow and interaction with the receptacle can continually be optimal, which results in a perfect pour, liquid status in the receptacle, and liquid flavor. As a non-limiting example, step 248 may be revisited numerous times during the dispensing of liquid to move the receptacle and/or spout to alter where the liquid is entering the interior volume of the receptacle, which can result in optimal liquid turbulence in the receptacle that produces the best status and flavor.

It is to be understood that even though numerous characteristics and configurations of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed. For example, the particular elements may vary depending on the particular application without departing from the spirit and scope of the present technology.

What is claimed is:

1. An apparatus comprising a controller connected to a sensor in a housing, the housing supporting a liquid dispensing spout connected to a liquid source, the sensor disposed adjacent a base support, the base support configured to contactingly support a liquid receptacle at a stationary orientation with respect to the housing, the controller configured to generate a liquid dispensing strategy and execute the liquid dispensing strategy with the liquid dispensing spout by altering an angle of the liquid dispensing spout with respect to the liquid receptacle using a spout angle adjustment mechanism coupled to the liquid dispensing spout, the angle of the liquid dispensing spout selected responsive to the sensor identifying a detected interior volume and a sidewall shape of the liquid receptable placed in the stationary orientation on the base support.

2. The apparatus of claim 1, wherein the sensor further identifies a clearance distance from an uppermost opening of the liquid receptacle to a lowermost portion of the liquid dispensing spout, and the angle is further altered in relation to the identified clearance distance.

3. The apparatus of claim 1, wherein the sensor visually maps a cross-sectional area of an opening of the liquid receptacle, an entirety of the interior volume of the liquid receptacle, and a relative position of the liquid receptacle to the liquid delivery spout.

4. The apparatus of claim 1, wherein an environment circuit is positioned in the housing and connected to the controller, the environment circuit configured to detect at least one environmental condition around the spout, the angle of the liquid dispensing spout further adjusted during the dispensing of the liquid into the liquid receptacle responsive to the detected at least one environmental condition.

5. The apparatus of claim 1, further comprising a receptacle tilt angle adjustment mechanism that induces a time-varying angular tilt of the stationary liquid receptacle on the base support during the dispensing of the liquid from the liquid dispensing spout.

6. The apparatus of claim 1, wherein a first angle is applied to the liquid dispensing spout to pour a first liquid into the liquid receptacle, and wherein a different, second angle is subsequently applied to the liquid dispensing spout to pour a different, second liquid into the liquid receptacle after the liquid receptacle has been emptied of the first liquid.

7. The apparatus of claim 1, wherein a prediction circuit is positioned in the housing and connected to the controller, the prediction circuit configured to predict at least one operational parameter of the spout in relation to the liquid receptacle.

8. The apparatus of claim 1, wherein a payment circuit is positioned in the housing and connected to the controller, the payment circuit configured to transact compensation from a customer in response to dispensing of liquid.

9. The apparatus of claim 1, wherein the controller is connected to a plurality of different sensors, each positioned within the housing.

10. The apparatus of claim 1, wherein the controller is connected to a plurality of different spouts, each extending from the housing, wherein each spout dispenses an associated liquid at a different respective angle to a corresponding, differently sized liquid receptacle.

11. A method comprising:

positioning a liquid receptacle onto a stationary base support proximal a housing, the housing comprising a controller connected to a sensor, the housing supporting a liquid dispensing spout connected to a liquid source;

detecting, with the sensor, parameters of the liquid receptacle including a height, opening size, sidewall contour, interior volume and material composition of the liquid receptacle;

generating a liquid dispensing strategy with the controller based on the detected parameters of the liquid receptacle; and executing the liquid dispensing strategy by altering an angle of the liquid dispensing spout with respect to the liquid receptacle using a spout angle adjustment mechanism coupled to the liquid dispensing spout, the angle transitioning from a first angle to a second angle during the dispensing of the liquid into the liquid receptacle, the angle selected responsive to the detected parameters of the liquid receptacle.

12. The method of claim 11, wherein the controller sequentially prompts a user to position multiple different liquid receptacles under the spout, each of the multiple different liquid receptacles having different ones of the parameters measured by the sensor and resulting in different respective angles of the liquid dispensing spout.

13. The method of claim 12, wherein the controller alters a dispensing parameter of the spout for at least one of the multiple different liquid receptacles, in accordance with the dispensing strategy.

14. The method of claim 11, wherein the controller dispenses a sample portion, in accordance with the dispensing strategy, in response to a user selecting a sample size of a liquid.

15. The method of claim 14, wherein the controller generates a new sample suggestion in response to feedback from the user after dispensing the sample portion.

16. The method of claim 11, wherein the dispensing strategy prescribes at least fluid pressure and spout angle for a plurality of different liquid receptacle shapes.

17. The method of claim 11, wherein the controller determines the dispensing strategy is not optimal for the liquid receptacle.

18. The method of claim 17, wherein the controller further activates a liquid receptacle tilt angle adjustment mechanism to induce a tilt in the liquid receptacle during the dispensing of liquid into the liquid receptacle.

19. The method of claim 11, wherein the controller selects a liquid pressure in response to calculating the interior volume of the liquid receptacle with the sensor.

20. The method of claim 11, wherein the controller moves the spout in relation to the liquid receptacle, in accordance with the dispensing strategy, while dispensing liquid into the liquid receptacle.

* * * * *